US007598631B2

(12) United States Patent
Szabados et al.

(10) Patent No.: US 7,598,631 B2
(45) Date of Patent: Oct. 6, 2009

(54) ADDRESSABLE POWER SWITCH

(75) Inventors: Barna Szabados, Oakville (CA); Roumanos Joseph Dableh, Oakville (CA); Kyle Van Bavel, Oakville (CA)

(73) Assignee: Fifth Light Technology Ltd., Oakville, Ontario (CA)

( * ) Notice: Subject to any disclaimer, the term of this patent is extended or adjusted under 35 U.S.C. 154(b) by 415 days.

(21) Appl. No.: 11/668,268

(22) Filed: Jan. 29, 2007

(65) Prior Publication Data

US 2008/0179968 A1 Jul. 31, 2008

(51) Int. Cl.
*H01H 47/00* (2006.01)

(52) U.S. Cl. ..... 307/140

(58) Field of Classification Search ..... 307/140; 361/155, 156

See application file for complete search history.

(56) References Cited

U.S. PATENT DOCUMENTS 3,629,608 A * 12/1971 Trindle ..... 307/140
6,107,698 A * 8/2000 Ochiai et al. ..... 307/43
6,987,334 B2 * 1/2006 Koehler ..... 307/140
7,075,253 B2 7/2006 Huber
7,077,253 B2 7/2006 Maienschein
7,288,857 B2 * 10/2007 Bartholomew et al. ..... 307/140

OTHER PUBLICATIONS

Manual, Dali AG, "Digital Addressable Lighting Interface, Activity Group" (2001).

* cited by examiner

*Primary Examiner*—Fritz M Fleming
*Assistant Examiner*—Dru M Parries
(74) *Attorney, Agent, or Firm*—Faegre & Benson LLP

(57) ABSTRACT

An addressable power switch for selectively connecting a device to main power in response to command instructions received over a control bus. The control bus supplies a low voltage power source and the addressable power switch includes an energy storage device and charge circuit for deriving a charge current from the low voltage power source and charging the energy storage device. The addressable power switch also includes a latching relay for connecting the device to main power. The change in state of the latching relay is realized through controlling discharge of the energy storage device, which supplies an energy pulse upon discharge. The switch may be used in connection with addressable lighting systems.

20 Claims, 4 Drawing Sheets

ADDRESSABLE POWER SWITCH

FIELD OF THE INVENTION

The present invention relates to an addressable power switch and, in particular, to such a switch having low power activation in either state.

BACKGROUND OF THE INVENTION

Power switches for connecting a load to a power source are commonplace. In the field of addressable lighting, for example, addressable power switches may be used to selectively connect lamps to the mains.

A known addressable power switch is connected to low power control lines and responds to switching commands containing its unique address by connecting or disconnecting one or more lamps, or their ballasts, to line power. The low power control lines may, in some embodiments, conform to the digital addressable lighting interface (DALI) standard described in IEC 60929. In others, they may conform to the digital signal interface (DSI) standard. In yet others, the control lines may be based on a proprietary interface. In any event, the known addressable power switch includes a relay for connecting the lamps to line power. In many cases the relay is a fail-open relay and the lamps are connected to line power only when the relay is energized. A control unit within the addressable power switch monitors the low power control lines and detects switching commands addressed to it. The control unit outputs a control signal to connect the relay to the low power control lines to energize the relay.

It would be advantageous to provide an addressable power switch with improved power efficiency.

SUMMARY OF THE INVENTION

In one aspect, the present application describes an addressable power switch for selectively connecting a device to main power in response to command instructions received over a control bus. The control bus supplies a low voltage power source and the addressable power switch includes an energy storage device and charge circuit for deriving a charge current from the low voltage power source and charging the energy storage device. The addressable power switch also includes a latching relay for connecting the device to main power. The change in state of the latching relay is realized through controlling discharge of the energy storage device, which supplies an energy pulse upon discharge. In one embodiment, the switch may be used in connection with addressable lighting systems.

In one particular aspect, the present application provides an addressable power switch for connecting a device to a main power source, the power switch being connected to a control bus, wherein the control bus includes a low power source. The addressable power switch includes an energy regulation stage for receiving the control bus input and outputting a regulated DC voltage derived from the low power source, a controller having an input port connected to the control bus input and an output port for supplying a control signal, an energy storage device, and a charge circuit connected to the energy regulation stage for charging the energy storage device using the regulated DC voltage. The switch also includes a switching stage for selectively connecting the device to the main power source in response to the control signal, and the switching stage includes a discharge switch and a power relay. The discharge switch is responsive to the control signal for connecting the energy storage device to the power relay thereby at least partly discharging the energy storage device through the power relay and actuating the power relay, wherein the power relay connects the main power to the device.

In another aspect, the present application provides an addressable power switch for connecting a device to a main power source, the power switch being connected to a control bus, wherein the control bus includes a low power source. The addressable power switch includes charging means connected to the control bus for generating a trickle charge current derived from the low power source, energy storage means for storing energy from the trickle charge current, and control means connected to the control bus for detecting addressed commands and for outputting a control signal to control discharge of the energy storage means. The addressable power switch further includes means for selectively connecting the device to the main power source in response to the control signal including a switch means and a relay means. The switch means is responsive to the control signal for connecting the energy storage means to the relay means thereby at least partly discharging the energy storage means through the relay means and connecting the main power to the device.

In yet a further aspect, the present application provides an addressable lighting control system. The system includes at least one lamp and a lighting control system including a central controller and at least one control line for distributing control instructions. The central controller includes a low power source for supplying power via the control bus. The system also includes an addressable power switch connected to the control bus for selectively connecting the at least one lamp to main power in response to the control instructions. The addressable power switch includes an energy regulation stage connected to the control bus and outputting a regulated DC voltage derived from the low power source, a controller having an input port connected to the control bus and an output port for supplying a control signal, an energy storage device, and a charge circuit connected to the energy regulation stage for charging the energy storage device using the regulated DC voltage. The addressable power switch also includes a switching stage for selectively connecting the at least one lamp to the main power source in response to the control signal. The switching stage includes a discharge switch and a power relay. The discharge switch is responsive to the control signal for connecting the energy storage device to the power relay thereby at least partly discharging the energy storage device through the power relay and actuating the power relay, wherein the power relay connects the main power to the at least one lamp.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

In some example embodiments below, the addressable power switch is described in the context of addressable lighting control systems. The switch is well suited to such applications; however, it is not limited to use in association with lighting systems. The switch may find application in any system in which addressable commands/controls are received over control lines and used to switch power to a device. Other examples include fans, air conditioners, pumps, heaters, appliances, or any other device that is within the power rating of the switch.

In the case of addressable lighting systems, there are a number of standards and protocols for control signaling. One such protocol is the DALI standard. While the switch may be of use in connection with DALI lighting systems, those skilled in the art will appreciated that it is not limited to such systems and may be used in connection with other control standards, protocols, or interfaces.

Figure 1:
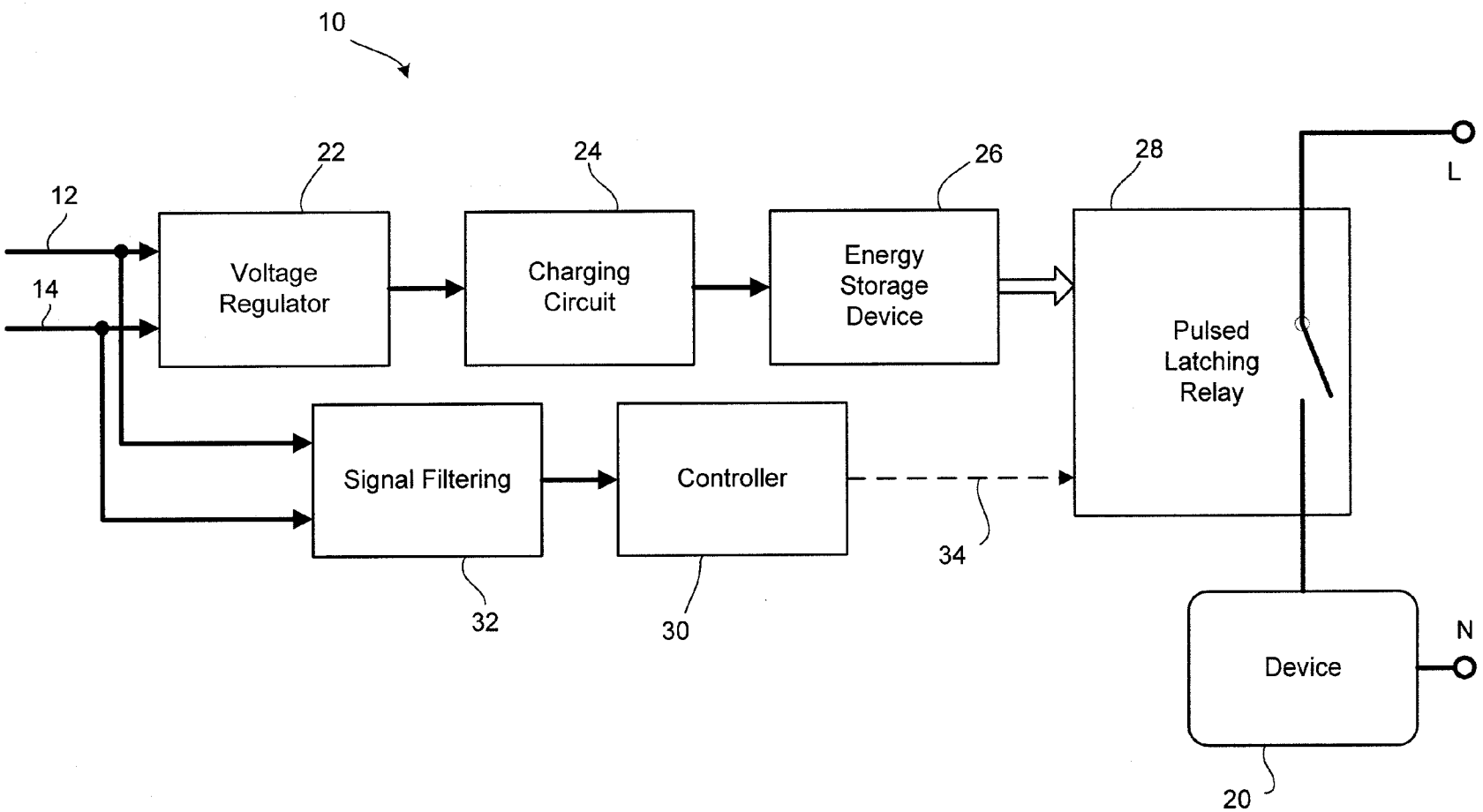
FIG. 1 shows a block diagram of an embodiment of an addressable power switch.

Reference is first made to FIG. 1, which shows a block diagram of an embodiment of an addressable power switch 10. The addressable power switch 10 is connected to control lines 12, 14. Based on switching commands received over the control lines 12, 14, the addressable power switch 10 selectively connects a device 20 to the mains, i.e. line power.

The addressable power switch 10 includes a voltage regulator 22, a charging circuit 24, an energy storage device 26, and a pulsed latching relay 28.

The control lines 12, 14 are low power control signaling lines that provide a low power source. In one embodiment, the control lines 12, 14 conform to the DALI standard and, accordingly, offer an approximately sixteen volt potential and approximately two milliamps of current per unit connected to the DALI bus, up to a maximum of 250 mA for a full DALI supply system. It will be appreciated that the control lines 12, 14, need not conform to the DALI standard and may be associated with a different addressable interface standard having different characteristics.

The voltage regulator 22 is connected to the control lines 12, 14 which provide the voltage regulator with input power. The voltage regulator 14 produces a regulated voltage output, which is supplied to the charging circuit 24. The charging circuit 24 is configured to produce a controlled low power current for charging the energy storage device 26. The charging circuit 24 is further configured to cease drawing significant power from the voltage regulator 22 once the energy storage device 26 is fully charged.

The energy storage device 26 is connected to the pulsed latching relay 28 and, on discharging, provides the pulse energy for actuating the pulsed latching relay 28.

A controller 30 governs the operation of the pulsed latching relay 28 by controlling when to discharge the energy storage device 26. The controller 30 outputs a control signal 34 that causes the energy storage device 26 to be connected to the pulsed latching relay 28 so as to discharge the energy storage device 26 and actuate the relay 28. In at least one embodiment, the control signal 34 actuates a switch for connecting the energy storage device 26 to the pulsed latching relay 28. It will be appreciated that this switching function based upon the control signal 34 may be implemented using a number of circuit elements and configurations of varying complexity.

The controller 30 determines when to actuate the relay 28 based upon commands received over the control lines 12, 14. Accordingly, the controller 30 includes input ports for receiving signals from the control lines 12, 14. The addressable power switch 10 may include a signal filtering stage 32 for conditioning the signals on the control lines 12, 14 prior to input to the controller 28. The nature of the signal filtering stage 32 may depend upon the operating characteristics of the control lines 12, 14 and the characteristics of the controller 30, including whether its input ports are analog or digital input ports. The range of possible signal filtering and its implementation will be within the understanding of those skilled in the art.

The controller 30 is configured, for example through software resident in memory and executed by a processor within the controller 30, to recognize commands and address information on the control lines 12, 14. The controller 30 is programmed and configured in accordance with the relevant standard governing addressable control communications for a given implementation.

By using the pulsed latching relay 28 to connect the device 20 to line power, the addressable power switch 10 avoids the energy loss associated with having to energize a relay to maintain its state. Moreover, the energy for pulsing the relay 28 to change its state is supplied from the rechargeable energy storage device 26, which in turn is charged by a controlled trickle charging circuit 24 that derives a controlled charge current from the low power source of the control lines 12, 14. This configuration avoids the necessity of drawing a significant current from the control lines to energize a relay to maintain its closed state to connect a device to main power.

In the addressable power switch 10 current is drawn from the control lines 12, 14 at a rate significant enough to recharge the energy storage device 26 over a reasonable period of time. In one embodiment, the addressable power switch 10 may be designed to permit pulsing the relay 28 to change its state at least three times on a single charge of the energy storage device 26, following which the energy storage device 26 must be recharged to permit further pulsing of the relay 28. The recharge rate, in one embodiment, is in the range of 10 to 30 seconds. It will be appreciated that the recharge rate in any given embodiment will depend upon the size of the pulse required, the capacity of the energy storage device 26, and the current available, among other factors. Faster or slower recharge rates may be suitable for certain embodiments. For example, in the case of HID lights a longer recharging time may be acceptable since a delay of 10 minutes may occur before the lamps may be re-fired in any event. Also in the case of HID lights the number of pulses required off of one full charge of the energy storage device 26 may be two since a quick ON-OFF cycle is all that may be expected in a very short timeframe due to the re-firing limitation.

In one embodiment, in which the control lines 12, 14 conform to the DALI standard, the current drawn by the addressable power switch 10 during charging of the energy storage device 26 is regulated to be less than 3.75 mA. In this manner, the current demands associated with charging or recharging the addressable power switch 10 are not a factor limiting the number of switches that may be connected to a DALI bus. Rather, the number of addressable switches that may be connected to the bus is limited by the number of available network addresses. It will be appreciated that in other embodiments, the current drawn may be regulated in view of different interface standards. Nevertheless, in such embodiments, the current may be regulated with a view to maximizing the number of devices that may be connected to the low voltage power bus.

It will also be appreciated an advantage of providing an energy storage device 26 having a sufficient charge capacity to deliver more than one charge pulse is that the addressable power switch 10 is capable of causing a state change of the relay 28 in the event of a power failure on the control lines 12, 14. This allows the controller 30, provided it has its own temporary backup power source, to cause the addressable power switch 10 to enter a configurable default state despite the loss of power on the control lines 12, 14. In other words, a user may configure the switch 10 to enter a selected state, ON or OFF, when power is lost on the control lines 12, 14.

Figure 2:
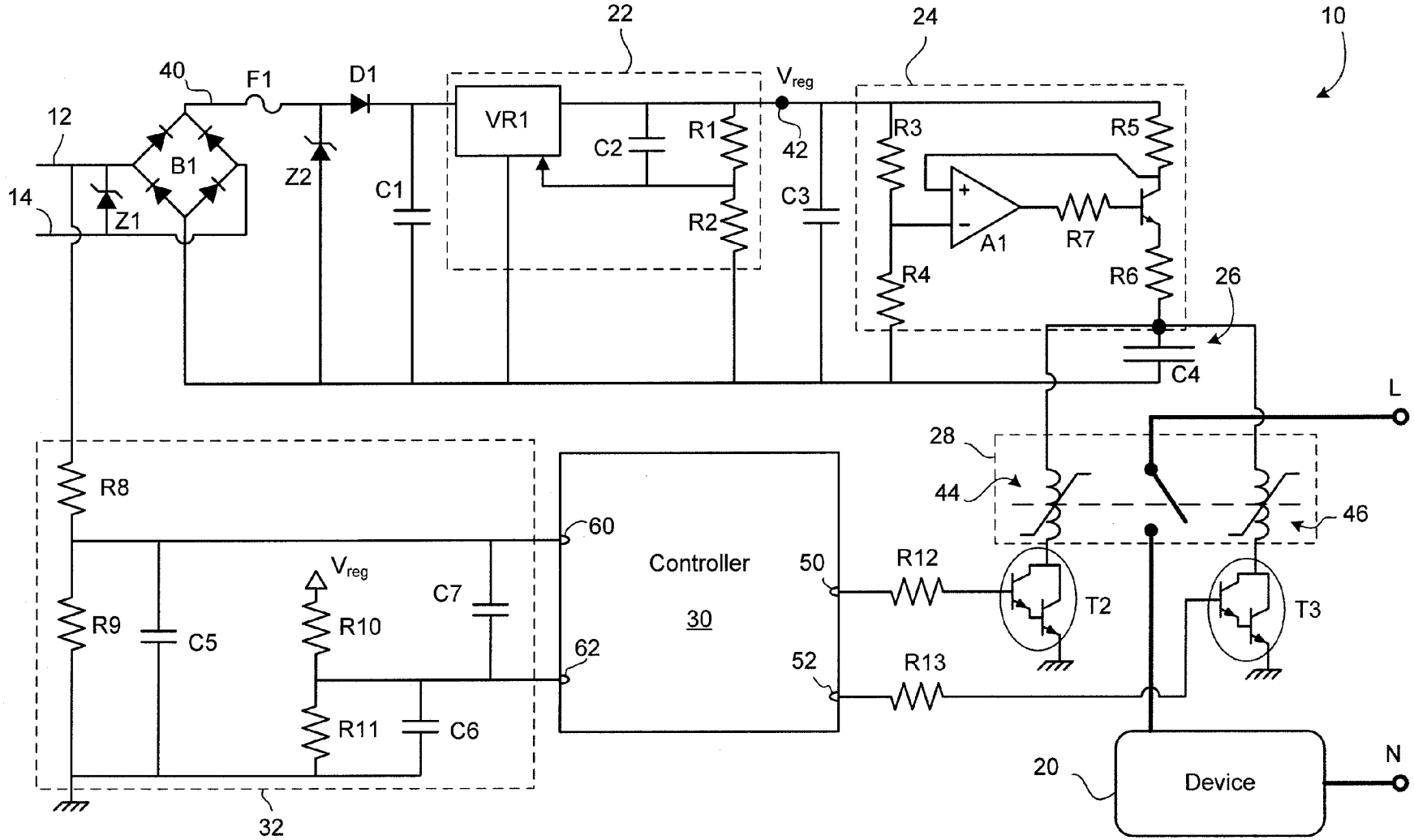
FIG. 2 shows a circuit diagram of an embodiment of the addressable power switch of FIG. 1.

Reference is now made to FIG. 2, which shows a circuit diagram of an embodiment of the addressable power switch 10 of FIG. 1.

In this embodiment, the energy storage device 26 is capacitor C4. In some other embodiments, the energy storage device 26 may include a rechargeable battery or other such energy storage elements.

At the input side of the voltage regulator 22, the control lines 12, 14 are initially shunted by a Zener diode Z1 for over-voltage protection. They are then connected to a bridge rectifier B1 to produce an unregulated voltage at reference point 40. A fuse F1 is connected to the positive output of the bridge rectifier B1. The other end of the fuse F1 is clamped by a second Zener diode Z2 and the output signal is passed through a further diode D1 before being connected to the input of the voltage regulator 22. The input of the voltage regulator 22 is also connected across a filter capacitor C1.

It will be appreciated that the Zener diodes Z1 and Z2 may be replaced with other devices for clamping voltage to prevent over-voltage, including, but not limited to, metal-oxide varistors. It will also be appreciated that the fuse F1 may be replaced with any other device providing an over-current protection. In one embodiment, a PTC thermistor may be used in place of the fuse F1.

The voltage regulator 22 includes a voltage regulator device VR1 that produces an output regulated voltage 42. The voltage regulator device VR1 is configured to receive a feedback voltage via a voltage divider through resistors R1 and R2 stabilized by capacitor C2. The voltage regulator 22 output also may include filtering via capacitor C3. The components R1, R2, C1, C2, C3 may be selected so as to minimize power consumption.

The charging circuit 24 is connected to the output of the voltage regulator 22 to receive the regulated voltage 42 and generate a controlled trickle current for charging the capacitor C4. The charging current 24 may, in some embodiments, use constant current diodes or transistors. In the present embodiment, the charging circuit 24 includes a low power operational amplifier A1. The op amp A1 has its negative terminal fed from a voltage divider via resistors R3 and R4, which are coupled across the regulated voltage 42. The positive terminal of the op amp 41 is arranged in a feedback loop with the collector of transistor T1. The output of the op amp A1 drives the base of transistor T1 through resistor R7, biasing the transistor T1 on so as to supply current to the capacitor C1 through resistors R5 and R6. As the capacitor C1 charges, the voltage at the emitter and collector of transistor T1 also rises until such point that the op amp A1 shuts off, which turns off the transistor T1. It will be appreciated that the turn off voltage is related to the voltage at the negative input terminal determined by the voltage divider established by resistors R3 and R4. Suitable values may be selected for resistors R3, R4, R5, R6, and R7 for a given implementation.

It will be understood that once the capacitor C4 has been charged and the transistor T1 has turned off, then the current consumption is limited to the current drawn by the Zener diodes Z1 and Z2, the feedback resistors R1 and R2, and the voltage divider resistors R3 and R4.

In one embodiment, the pulsed latching relay 28 includes two coils 44, 46. One of the coils is an ON coil 44, which when energized causes the mechanical armature to contact the common terminal, thereby closing the circuit and connecting the device 20 to the main power source. The other coil is an OFF coil 46, which when energized cause the mechanical armature to disconnect from the common terminal, thereby open circuiting the connection between the device 20 and the main power source. The armature is configured to maintain its last state in the event of a failure.

There are at least two possible failure scenarios. In the first, power is lost on the AC mains. In this case, the armature may be configured to maintain its last state. In the second, power may be lost on the control lines 12, 14. In this case, the controller 30 may be configured to place the switch 10 into a pre-selected state. The capacitor C4 is sized to as to have sufficient charge to deliver more than one pulse and, in some cases, at least three pulses on a full charge. Accordingly, even with a loss of power on the control lines 12, 14, immediately following a pulse of the relay 28, the switch 10 retains the capacity to re-pulse the relay 28 so as to change the state of the relay 28 to a pre-selected state.

In another embodiment, the pulsed latching relay 28 may be configured as a solenoid operating a ratchet and cam. This type of latching relay has a single input port for pulsing the relay to change between states.

Referring still to FIG. 2, each of the coils 44, 46 of the pulsed latching relay 28 has a terminal connected to the capacitor C4. The other terminals of the coils 44, 46 are connected to Darlington transistors T2, and T3, respectively. The transistors T2 and T3 having their bases connected to output ports 50 and 52 of the controller 30 through resistors R12 and R13, respectively. Although the present embodiment employs Darlington transistors T2 and T3, it will be appreciated that many other types of transistor may be used, including but not limited to MOSFETs, BJT transistors, Darlington BJTs, IGBT, and others.

It will be appreciated that the controller 30 may cause a pulsed discharge of the capacitor C4 through one of the coils 44, 46 by outputting a pulse signal through one of its output ports 50, 52. The controller 30 may be configured to output a pulse of sufficient duration to bias on the respective Darlington transistor T3 or T4, thereby connecting a terminal of one of the coils 44, 46 to ground and causing the capacitor C4 to discharge through the coil 44, 46 energizing it and actuating the relay 28.

The decision to pulse the pulsed latching relay 28 is made by the controller 30 based upon input received via the control lines 12, 14. The control lines 12, 14 carry various commands and instructions addressed to particular devices 20, which are initially filtered and/or conditioned by the signal filtering stage 32. The data on the control lines 12, 14 is first passed through a voltage divider made up of resistors R8 and R9, to bring the voltage of the control lines 12, 14 down to a usable level for the controller 30, which may, for example, operate at a bus voltage of 5 V or 3.5 V. The reduced voltage is also filtered by capacitor C5 to produce a filtered control input signal 60.

The regulated voltage 42 from the voltage regulator 22 is used to generate a control signal threshold voltage 62. In particular, the regulated voltage 42 is reduced by voltage divider R10 and R11, filtered by capacitor C6, and input to the controller 30 as the control signal threshold voltage 62.

Both the filtered control input signal 60 and the control signal threshold voltage 62 are input to respective analog input ports on the controller 30. A common mode noise reduction capacitor C7 may be connected across the inputs.

Based on the input signals, the controller 30, operating under stored program control, is configured to detect digital bits within the filtered control input signal 60 and to interpret them accordingly. In particular, the controller 30 is configured to recognize commands or instructions addressed to it and to respond with the appropriate action. The appropriate action may, in some cases, include pulsing the latched relay 48 to connect or disconnect the device 20 from the main power source.

It will be appreciated that the functions of detecting addressed instructions on the control lines 12, 14 and responding accordingly may be implemented in a variety of manners. One alternative embodiment includes feeding the filtered control input signal 60 and the control signal threshold voltage 62 into a comparator and supplying the hardware decoded state to a port of a microcontroller. Other embodiments will be apparent to those skilled in the art.

Figure 3:
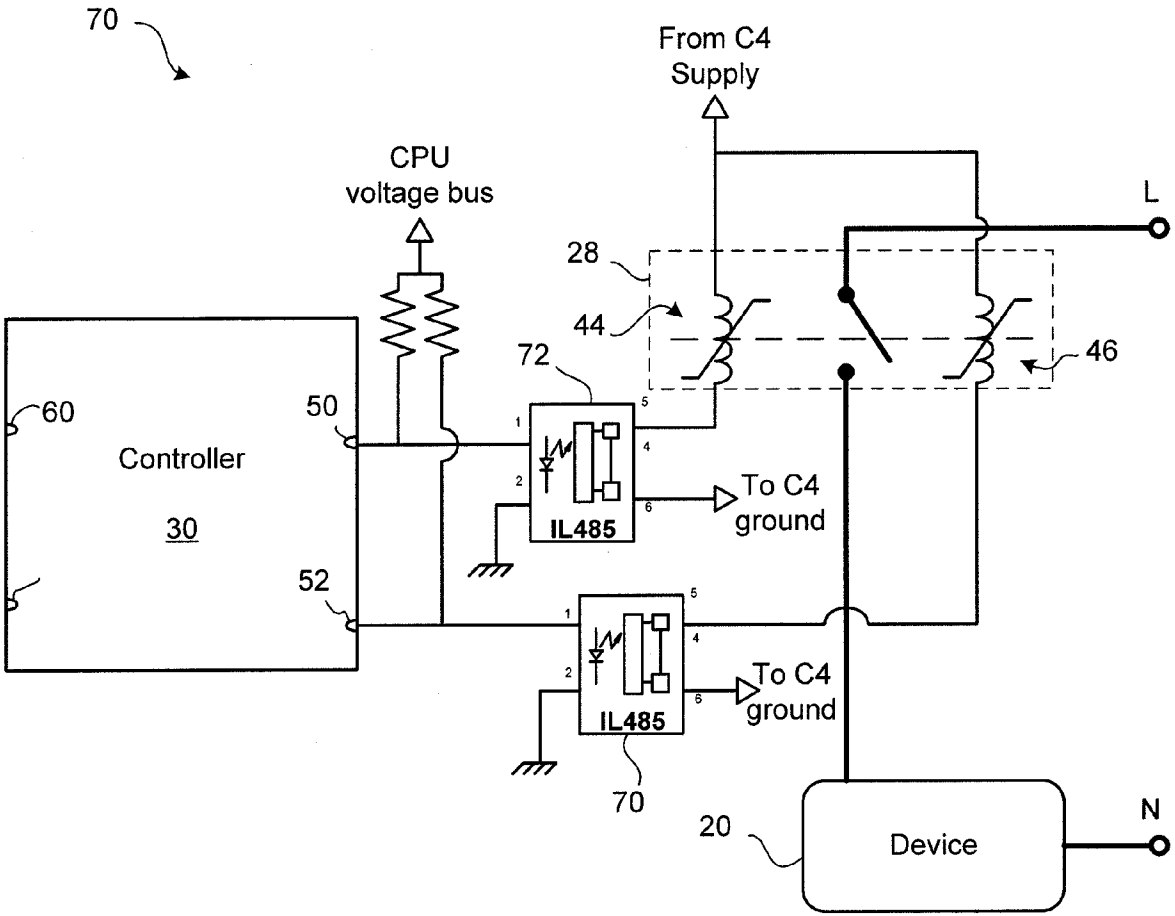
FIG. 3 shows another embodiment of a relay control circuit.

Reference is now made to FIG. 3, which shows another embodiment of a relay control circuit 70. The relay control circuit 70 may incorporate opto-isolation. In this example embodiment, each of the coils 44, 46 is connected to the driven side of an optocoupler 72, 74, which in one embodiment is an IL485 optocoupler manufactured by Siemens, Germany. It will be appreciated that other optocouplers may be employed. The output ports 50, 52 of the controller 30 are connected to the primary side of the optocouplers 72, 74.

The opto-isolation of the relay 28 may be of particular relevance in an embodiment in which the relay has a single coil activated from an H-Bridge. In such an embodiment, the relay 28 contains a single coil connected within an H-Bridge. The controller 30 activates the H-Bridge so as to supply a negative or positive pulse to the coil. The polarity of the pulse corresponds to selecting an open or closed state for the relay 28. Those skilled in the art will appreciate the variations and range of possible power relays that may be employed to connect or disconnect a load from the mains in response to a pulse.

Figure 4:
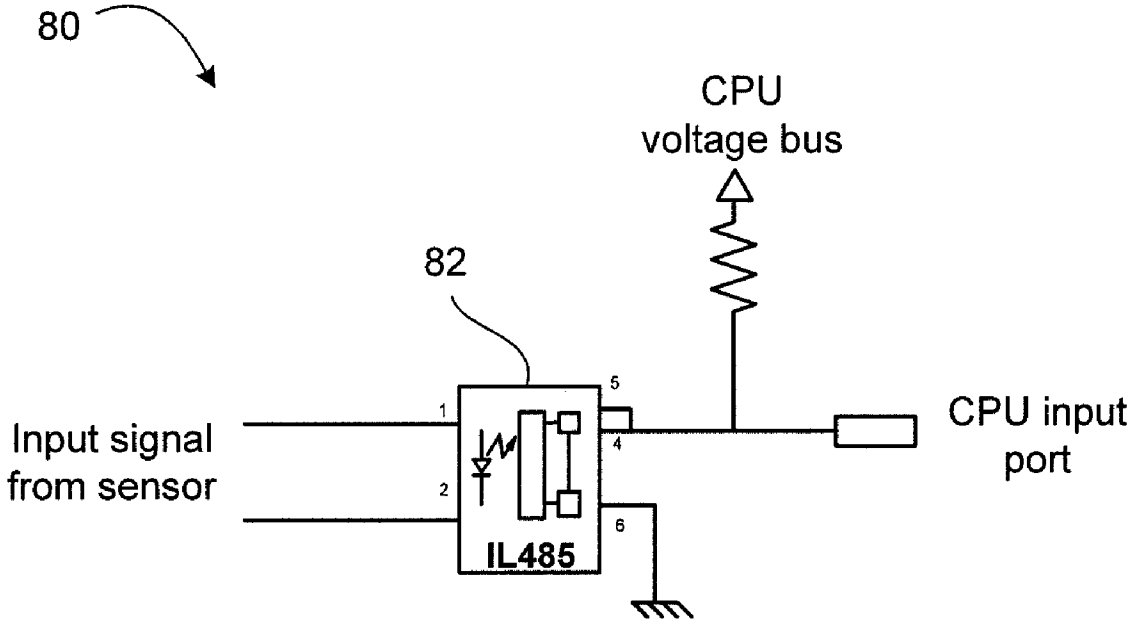
FIG. 4 shows an embodiment of a status feedback circuit.

In some embodiments, the addressable power switch 10 may include feedback circuits for obtaining status data regarding the switching state or the device 20. Reference is now made to FIG. 4, which shows an embodiment of a status feedback circuit 80. The feedback circuit 80 includes an isolation stage 82, which in this embodiment is implemented as an optocoupler. The output side of the optocoupler supplies a status signal 84 which may be input to the controller 30.

The status data may include data relating to voltage level, current consumed in the load, power consumed by the load, temperature or speed of a shaft. The data may be obtained from analog or digital sensors, as will be appreciated by those skilled in the art.

By way of example, in yet another embodiment a sensor may provide a digital word output. The addressable power switch 10 may include a parallel-to-serial converter chip to convert the digital sensor word output to a serial bit stream for input to the controller 30.

By way of another example, the controller 30 may include an integral analog to digital converter and several analog input channels. Feedback data from an analog sensor may be buffered by an emitter-follower operational amplifier to provide a very large input impedance before being connected to an analog input port on the controller 30.

Similar circuits may be used to send control and/or command signals from the controller 30 to the device 20 or related components. In some cases, the controller 30 may output serial data intended for a parallel input to a device. In such cases, a serial-to-parallel chip may be included in the addressable power switch 10. The serial-to-parallel chip may be clocked by the controller 30 in some embodiments.

In yet other embodiments, the controller 30 may include an analog output port for supplying analog signals. In such an embodiment, the controller 30 may output analog signals for input to a device so as to control the device. An emitter-follower operational amplifier may buffer the analog output before it is input to the device. A further amplifier may also be used to boost the analog signal. The types and configurations of the circuits for enabling output signals from the controller 30 will be appreciated by those of ordinary skill in the art.

In one embodiment, the controller 30 includes a pulse-width modulation (PWM) pin. The PWM signal may be used to drive an optocoupler, which in turn controls a load-side power converter. In the case where a DC voltage is required, the power converter may be a chopper. In the case of an AC voltage, the converter may be an inverter circuit. Such a circuit may be used to control a variety of power devices.

Examples of devices that may be controlled and switched by way of the addressable power switch 10 described above include thermostats, motors, fans, vents, HVAC systems, appliances, and lights. Other examples will be apparent to those of ordinary skill in the art.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An addressable power switch for connecting a device to a main power source, the power switch being connected to a control bus, wherein the control bus includes a low power source, comprising:

an energy regulation stage for receiving the control bus input and outputting a regulated DC voltage derived from said low power source;

a controller having an input port connected to said control bus input and an output port for supplying a control signal;

an energy storage device;

a charge circuit connected to the energy regulation stage for charging the energy storage device using said regulated DC voltage; and a switching stage for selectively connecting said device to said main power source in response to said control signal, said switching stage including a discharge switch and a power relay, wherein said discharge switch is responsive to said control signal for connecting said energy storage device to said power relay thereby at least partly discharging said energy storage device through said power relay and actuating said power relay, wherein said power relay connects said main power to said device.

2. The addressable power switch claimed in claim 1, wherein said power relay comprises a pulsed latched power relay.

3. The addressable power switch claimed in claim 2, wherein said pulsed latched power relay includes first input ports for a first coil and second input ports for a second coil, and wherein said first coil is configured to connect said main power to said device and said second coil is configured to disconnect said main power from said device.

4. The addressable power switch claimed in claim 3, wherein said discharge switch comprises a first discharge switch, said switching stage further includes a second discharge switch, said first input ports are connected to said energy storage device and to said first discharge switch, and said second input ports are connected to said energy storage device and to said second discharge switch.

5. The addressable power switch claimed in claim 1, wherein said power relay includes a first input port for connecting said main power to said device in response a first pulse and a second input port for disconnecting said main power from said device in response to a second pulse, and wherein said discharge switch is connected to said first input port and is configured to cause said first pulse through discharge of said energy storage device, and wherein said switching stage includes a second discharge switch connected to said second input port and configured to cause said second pulse through discharge of said energy storage device.

6. The addressable power switch claimed in claim 1, wherein said charge circuit comprises a current circuit for deriving a charge current from said regulated DC voltage for charging said energy storage device, a voltage divider connected to said regulated DC voltage, said voltage divider producing a threshold voltage, and a comparator for comparing said threshold voltage with a charge voltage of said energy storage device, and wherein said charge circuit includes a switch connected to said comparator for turning off said charge current when said charge voltage reaches said threshold voltage.

7. The addressable power switch claimed in claim 1, wherein said discharge switch includes an optocoupler.

8. The addressable power switch claimed in claim 1, wherein said device includes a sensor configured to produce a sensor output signal, said sensor output signal representing data regarding operation of said device, and wherein said addressable power switch includes a sensor input circuit for receiving said sensor output signal, wherein said sensor input circuit is connected to an input port of said controller.

9. The addressable power switch claimed in claim 1, wherein said device comprises at least one lamp.

10. The addressable power switch claimed in claim 9, wherein said control bus comprises a control communications line from a Digital Addressable Lighting Interface (DALI) control system.

11. The addressable power switch claimed in claim 1, wherein said control bus is configured to transmit addressed instructions including state change instructions, and wherein said controller is configured to detect said state change instructions addressed to said device, and to output said control signal in response to said detection.

12. An addressable power switch for connecting a device to a main power source, the power switch being connected to a control bus, wherein the control bus includes a low power source, comprising:

charging means connected to said control bus for generating a trickle charge current derived from said low power source;

energy storage means for storing energy from said trickle charge current;

control means connected to said control bus for detecting addressed commands and for outputting a control signal to control discharge of said energy storage means; and means for selectively connecting said device to said main power source in response to said control signal including a switch means and a relay means, wherein said switch means is responsive to said control signal for connecting said energy storage means to said relay means thereby at least partly discharging said energy storage means through said relay means and connecting said main power to said device.

13. The addressable power switch claimed in claim 12, wherein said relay means comprises latched means for switching between a connected state and a disconnected state in response to an input pulse, and wherein said energy storage means is configured to supply said input pulse through discharge.

14. The addressable power switch claimed in claim 13, wherein said latched means comprises a mechanical means for maintaining state in the event of power failure.

15. The addressable power switch claimed in claim 12, wherein said charging means includes means for controlling said trickle current based upon a charge state of said energy storage means.

16. The addressable power switch claimed in claim 12, wherein said switch means comprises first switch means for causing said relay means to latch into a connected state in which said device is connected to main power, and wherein said means for selectively connecting further comprises second switch means for causing said relay means to latch into a disconnected state in which said device is disconnected form main power.

17. The addressable power switch claimed in claim 16, wherein said control means is connected to said first switch means and to said second switch means and is configured to output a first control signal to said first switch means and to output a second control signal to said second switch means.

18. An addressable lighting control system comprising:

at least one lamp;

a lighting control system comprising a central controller and at least one control bus for distributing control instructions, said central controller including a low power source for supplying power via said control line;

an addressable power switch connected to said control bus for selectively connecting said at least one lamp to main power in response to said control instructions, the addressable power switch including an energy regulation stage connected to said control bus and outputting a regulated DC voltage derived from said low power source;

a controller having an input port connected to said control bus and an output port for supplying a control signal;

an energy storage device;

a charge circuit connected to the energy regulation stage for charging the energy storage device using said regulated DC voltage; and a switching stage for selectively connecting said at least one lamp to said main power source in response to said control signal, said switching stage including a discharge switch and a power relay, wherein said discharge switch is responsive to said control signal for connecting said energy storage device to said power relay thereby at least partly discharging said energy storage device through said power relay and actuating said power relay, wherein said power relay connects said main power to said at least one lamp.

19. The addressable lighting control system claimed in claim 18, wherein said power relay comprises a pulsed latched power relay.

20. The addressable lighting control system claimed in claim 18, wherein said power relay includes a first input port for connecting said main power to said device in response a first pulse and a second input port for disconnecting said main power from said device in response to a second pulse, and wherein said discharge switch is connected to said first input port and is configured to cause said first pulse through discharge of said energy storage device, and wherein said switching stage includes a second discharge switch connected to said second input port and configured to cause said second pulse through discharge of said energy storage device.

* * * * *